United States Patent [19]

Yanagida et al.

[11] 3,989,605

[45] Nov. 2, 1976

[54] METHOD FOR CONTINUOUS ELECTROLYTIC COLORING OF ALUMINUM ARTICLES

[75] Inventors: Kiyomi Yanagida; Tadashi Hirokane; Tadashi Tsukiyasu; Tomoari Sato, all of Nagoya, Japan

[73] Assignee: Sumitomo Chemical Company, Limited, Osaka, Japan

[22] Filed: Aug. 26, 1975

[21] Appl. No.: 607,961

Related U.S. Application Data

[63] Continuation-in-part of Ser. No. 450,259, March 11, 1974.

[30] Foreign Application Priority Data

Mar. 9, 1973 Japan ..... 48-28143

[52] U.S. Cl. ..... 204/28; 204/35 N

[51] Int. Cl.[2] ..... C25D 7/06; C25D 11/22

[58] Field of Search ..... 204/28, 58, 35 N

[56] References Cited

UNITED STATES PATENTS

| | | | |
|---|---|---|---|
| 3,079,308 | 2/1963 | Ramirez et al. | 204/28 |
| 3,759,801 | 9/1973 | Patrie et al. | 204/35 N |
| 3,766,043 | 10/1973 | Herrmann et al. | 204/28 |

*Primary Examiner*—R. L. Andrews

*Attorney, Agent, or Firm*—Sughrue, Rothwell, Mion, Zinn & Macpeak

[57] ABSTRACT

A method for electrolytic coloring of aluminum articles which comprises continuously supplying an aluminum strip or wire into anodic oxidation bath and then into electrolytic coloring bath, anodizing the aluminum strip or wire to form thereon an oxide film or layer, and electrolytic coloring the oxide film or layer by means for permitting the aluminum strip or wire to act as an anode in the anodic oxidation bath and as a cathode in the electrolytic coloring bath without connecting the aluminum strip or wire directly to a power source.

7 Claims, 2 Drawing Figures

METHOD FOR CONTINUOUS ELECTROLYTIC COLORING OF ALUMINUM ARTICLES

This is a continuation in part of patent application Ser. No. 450,259, filed Mar. 11, 1974.

BACKGROUND OF THE INVENTION

1. Field of the Invention

The present invention relates to a method for continuously electrolytic coloring of strips or wires of aluminum or aluminum base alloys (hereinafter, for brevity, both aluminum and aluminum alloys will be designated "aluminum" in this specification). More particularly, the invention relates to a method for continuously conducting a first anodic oxidation of aluminum strips or wires and then an electrolytic coloration of the anodic coating thus obtained.

2. Description of the Prior Art

For continuously coloring the anodic coating of aluminum strips or wires, a method has hitherto been employed in which an aluminum strip or wire is subjected to a degreasing treatment as a pre-treatment, and after forming an oxide film or layer on the aluminum strip or wire by an anodization, the anodized article is continuously immersed in a dyeing bath containing an organic dye. This method is useful in that aluminum strips or wires of various desired colors can be obtained in a comparatively short period of time, but has the defects that the colored aluminum articles obtained by the method are poor in weatherability and are faded by exposure for a long period of time. Therefore, such a conventional method is unsuitable for building materials, etc., which have recently become in great demand.

On the other hand, as a method of obtaining a colored anodic coating on an aluminum surface having a high resistance in weathering, a method in which aluminum articles are anodized in an electrolytic bath containing an organic acid such as sulfosalicylic acid and a method in which articles of an aluminum alloy containing chromium and manganese are subjected to an anodization treatment in an aqueous sulfuric acid solution are known. In these known methods, the formation of the anodic oxide film or layer and the coloring of the oxide film or layer are conducted simultaneously in the same bath, but there is a difficulty that insufficient coloring is achieved if the thickness of the oxide film or layer formed on the aluminum article or aluminum alloy article is less than about 15 microns although the extent of coloring depends on the electrolytic conditions and the nature of the aluminum alloy. Therefore, in order to obtain desirable coloring using such known methods, a large amount of electrical energy is required, and further, since the oxide film formed by such methods has a high hardness, the oxide film formed on an aluminum strip or wire tends to be cracked when the aluminum article is continuously withdrawn from the anodic oxidation bath, which makes these prior art methods unsuitable for continuous treatment.

We have previously discovered an improved method of coloring aluminum articles by anodizing the aluminum articles in an anodic oxidation bath to form an anodic coating on aluminum, and then electrolytically coloring the oxide coating in an electrolyte containing a specific acid or water-soluble metal salt as disclosed in DT-OLS 2112927. By our previously discovered method, a colored oxide film or layer having high weatherability or fade resistance can be formed on an aluminum or aluminum alloy article such as an aluminum plate without requiring a large amount of electrical energy.

As the results of further investigations, the inventors have found that the method previously discovered can be also applied to the continuous operation of electrolytic coloring of aluminum strips or wires and have discovered a novel and simple apparatus of the present invention suitable for the continuous formation of colored anodic oxide coatings having excellent weatherability or fade resistance on an aluminum strip or wire.

SUMMARY OF THE INVENTION

An object of this invention is, therefore, to provide a method for continuously conducting an anodic oxidation and an electrolytic coloring of an aluminum strip or wire without need for a large amount of electrical energy.

Another object of this invention is to provide a method for continuously conducting first an anodic oxidation and then an electrolytic coloring of an aluminum strip or wire for forming a colored anodic coating on the aluminum strip or wire, this film or layer having excellent weatherability or fade resistance.

Still another object of this invention is to provide a method for continuously conducting an anodic oxidation and an electrolytic coloring of an aluminum strip or wire without the necessity for connecting the continuously traveling aluminum strip or wire directly to a power source.

That is, the present invention provides a method for continuous electrolytic coloring of an aluminum strip or wire which comprises continuously supplying an aluminum strip or wire into an anodic oxidation bath comprising an aqueous solution containing sulfuric acid and then into an electrolytic coloring bath comprising an aqueous solution containing at least one of a nickel salt, a cobalt salt, a copper salt, a tin salt, a ferrous salt and selenious acid, anodizing the aluminum strip or wire in said anodic oxidation bath having a cathode disposed therein, and electrolytically coloring the anodized aluminum strip or wire as a cathode in said electrolytic coloring bath having an anode disposed therein, while the cathode in the anodic oxidation bath and the anode in the electrolytic coloring bath being electrolytically connected to a power source to cause the aluminum strip or wire to function as an anode in the anodic oxidation bath and to function as a cathode in the electrolytic coloring bath without connecting the aluminum strip or wire directly to a power source.

DESCRIPTION OF THE PREFERRED EMBODIMENTS

Figure 1:
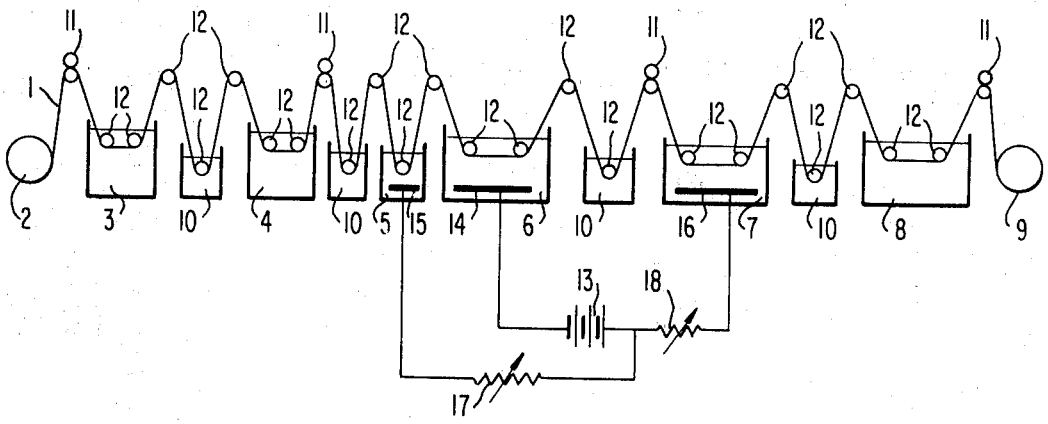
FIG. 1 illustrates one embodiment of this invention.

The anodic oxidation bath composition used in this invention is usually an aqueous solution of 10 to 55% sulfuric acid, but, if desired, the bath may further contain a small amount of a salt such as magnesium chloride, sodium sulfate, magnesium sulfate, sodium chloride, etc.; a carboxylic acid; an organic sulfonic acid; and/or an amine.

It is desirable that the thickness of the oxide film formed on an aluminum strip or wire by the anodic oxidation be thicker than 2 microns. That is, if the thickness of the oxide film is less than 2 microns, the oxide film formed on the aluminum strip or wire tends to not be colored uniformly by the electrolytic coloring treatment. If the thickness of the oxide film formed is 2 to 3 microns, the film can be colored a comparatively light color, and if the thickness is thicker than about 4 microns, the oxide film can be easily colored a deep color. However, with a thickness of the oxide film thicker than about 4 microns, the color tone obtained is substantially constant regardless of the thickness of the film. Therefore, in such a range of thicknesses, an aluminum strip or wire having quite stable or constant color is obtained by the present invention as compared with the conventional techniques in which the color of the oxide film formed depends greatly on the thickness of the oxide film. In general, it is preferable that the thickness of the oxide film formed on an aluminum strip or wire in the anodic oxidation bath of this invention be in a range of 2 to 15 microns when the anodic oxidation is conducted at room temperature or temperatures lower than room temperature, but the thickness of the oxide film may be as thick as about 25 microns when the anodic oxidation is conducted at high temperatures since in such case an oxide film having comparatively high elasticity can be formed. It is desired, however, that the thickness of the oxide film formed on the aluminum strip or wire be in a range of about 2 to 6 microns, if considering the mechanical processing of colored aluminum articles such as press forming, embossing, and roll-forming.

The electric current used in the anodic oxidation can be a direct current or direct and alternating superposed currents, and in the latter case, the occurrence of local dissolution of the oxide film formed can be prevented.

The aluminum strip or wire having the oxide film or layer formed in the anodization is, then, continuously immersed in an electrolytic bath containing at least one of a nickel salt, a cobalt salt, a copper salt, a tin salt, a ferrous salt, and selenious acid prior to the sealing treatment. If necessary, the electrolytic bath may contain at least one of ammonium chloride, ammonium sulfate, boric acid, sulfuric acid, an organic acid, etc., for controlling the conductivity and pH thereof.

The bath composition for the electrolytic coloring bath used in this invention is selected suitably from the above-described components depending on the desired color. For example, specific examples of the components used for the bath composition are nickel sulfate, nickel chloride, cobalt sulfate, cupric chloride, stannous sulfate, and selenious acid, and by the combinations of the electrolytic conditions and the aforesaid components, various colors can be obtained.

For example, when nickel sulfate or nickel chloride is used for the electrolytic bath, a color in the range of yellow-brown, brown, to black-brown is obtained; when cobalt sulface is used, the color substantially similar to the use of nickel sulfate is obtained; when cupric chloride is used, a red-brown color is obtained; when stannous sulfate is used, a color in a range of yellow-brown, black-brown, to black is obtained; and when ferrous salt is used, a yellow color is obtained. Furthermore, when selenious acid is used a color in a range of yellow to reddish orange is obtained.

The aluminum strip or wire immersed continuously in the electrolytic coloring bath is rendered capable of functioning as a cathode indirectly by the action of the electrode disposed in the bath and is electrolyzed by direct current in the bath.

The current density and the electrolytic period of time in the bath are controlled by the area of the aluminum strip or wire immersed, the amount of electric current applied, and the period of immersion of the aluminum strip or wire.

An example of the change of colors obtained by the combinations of the electrolytic bath composition and the electrolytic conditions is illustrated below. That is, when an aluminum strip or wire having an oxide film of 8 microns thick formed thereon is immersed in an aqueous solution containing 50 g/liter of nickel sulfate and 30 g/liter of boric acid at 25° C, the oxide film can be colored yellow-brown to black-brown within 3 minutes of electrolysis.

For example, when the electrolysis is conducted at a current density of 0.2 to 0.3 ampere/dm$^2$, the oxide film is colored black-brown by an electrolysis of 2 to 2.5 minutes; when conducted at 1 ampere/dm$^2$, the film is colored brown by an electrolysis of 30 seconds; when conducted at 1.5 amperes/dm$^2$, the film is colored yellow-brown by an electrolysis of 10 seconds; and when conducted at 2.0 amperes/dm$^2$, the film is colored yellow-brown by an electrolysis of 5 seconds. Also, in general, the higher the current density employed, the more uniform is the color obtained.

Moreover, when a small amount of sulfuric acid or ammonium chloride is added to the electrolytic bath, the conductivity of the electrolytic bath increases to make it difficult to obtain a deep brown color, but the change in color caused by the changes in current density and the period of time of electrolysis becomes less, which facilitates the continuous coloring operation.

This invention will be explained practically by the embodiments illustrated in the accompanying drawings, but it is to be understood that various modifications within the scope of this invention are also employed in this invention in addition to the embodiment shown below.

As schematically shown in FIG. 1, an aluminum strip or wire 1 is continuously supplied from a supply roll or a recoiler 2, passed successively through a degreasing bath 3, an etching bath 4, a current supplying bath 5, an anodic oxidation bath 6, an electrolytic coloring bath 7, and a sealing bath 8, and is rolled up or recoiled on a wind-up roll or recoiler 9. If desired, several wash baths 10 and drive rollers 11 may be disposed between the aforesaid baths as illustrated in the figure, and guide rollers 12 are also disposed suitably for enabling the smooth passage of the aluminum strip or wire through each bath. The negative terminal of a d.c. power source 13 is connected to an electrode 14 disposed in the anodic oxidation bath 6 and the positive terminal is connected through a rheostat 17 to an electrode 15 disposed in the current supply bath 5 and through a rheostat to an electrode disposed in the electrolytic coloring bath 7. Using the rheostats 17 and 18, the electric current supplied to the current supply bath 5 and the electrolytic coloring bath 7 can be controlled, respectively, whereby the electric current in the anodic oxidation bath 6 can also be changed.

In the embodiment of this invention as described above, the aluminum strip or wire 1 supplied from the supply roll or recoiler 2 is first continuously introduced in the degreasing bath 3 by means of the first drive rollers 11. Plural supply rolls or recoilers 2 can be employed for treating plural aluminum strips or wires simultaneously. The degreasing bath 3 contains an organic solvent, an aqueous 5–25% sulfuric acid solution, or a neutral detergent solution for removing oils and fats from the surface of the aluminum strip or wire and is maintained at a definite temperature at use.

The aluminum strip or wire 1 from the surface of which oils and fats have been removed is then introduced into the etching bath 4 through the wash bath 10 disposed between the degreasing bath 3 and the etching bath 4. The etching bath is employed for slightly etching the aluminum strip or wire to provide a matt surface and contains usually an aqueous solution of sodium hydroxide, potassium hydroxide, or sodium carbonate or a chemical etching solution.

The aluminum strip or wire, the surface of which has been etched or chemically matted, is then introduced into the current supply bath 5 through the wash bath 10. The current supply bath is employed for controlling independently the amount of electric current supplied to the anodic oxidation bath 6 and the electrolytic coloring bath 7, and in the bath the aluminum strip or wire acts as a cathode to the electrode 15 through the electrolyte in the bath without being connected to the power source. Thus, hydrogen gas is generated on the surface of the aluminum, and electrolytic degreasing of the aluminum article is also accomplished in the bath. The electrolyte used in the current supply bath 5 is an aqueous solution of about 10 to 30% sulfuric acid or an aqueous solution of about 3 to about 30% sodium hydroxide or potassium hydroxide. It is desirable, however, in the case of using an aqueous solution of sodium hydroxide or potassium hydroxide, to employ means of preventing the sodium ion or potassium ion from entering the electrolytic coloring bath 7, such as, for example, shower, spray, etc.

In another embodiment of this invention, the current supply bath 5 can be omitted by supplying an electric current to the anodic oxidation bath 6 and the electrolytic coloring bath 7 so that the amount of electric current is the same in the both baths and controlling the electrolytic conditions in each bath by controlling the immersion period or the immersion area of the aluminum strip or wire introduced into each bath.

The aluminum strip or wire passed through the current supply bath 5 is, then, introduced into the anodic oxidation bath 6, in which it acts as an anode to the electrode 14 connected to the power source 13. In employing a direct current and an alternating current simultaneously, a known d.c. — a.c. superposing power source may be used in place of the d.c. power source 13.

The anodic oxidation bath 6 is for forming an oxide film on the aluminum article and an aqueous solution of sulfuric acid is usually used as the electrolyte. In the bath, the anodic oxide film having a thickness thicker than 2 microns is formed on the aluminum strip or wire. The thickness of the oxide film formed on the surface of the aluminum strip or wire in the anodic oxidation bath is controlled by the amount of electric current passing per unit area of the aluminum article. The bath temperature also influences the thickness of the oxide film, but is sufficient in the range of room temperature to about 40° C.

The aluminum strip or wire passed through the anodic oxidation bath 6 is, then, introduced in the electrolytic coloring bath 7 through the wash bath 10 and it acts in the bath 7 as a cathode to the electrode 16 connected to the power source. The electrolytic coloring bath 7 is for coloring the anodized aluminum strip or wire by d.c. electrolysis and contains an aqueous solution of at least one of a nickel sat, a cobalt salt, a copper sat, a tin salt, a ferrous salt, and selenious acid. The d.c. current passes from the anode 16 to the anodic oxidation bath 6 through the coloring electrolyte and the aluminum strip or wire. A part of the d.c. current also passes from the current supply bath 7 to the anodic oxidation bath 6. To control the amount of the electric current in each route, the rheostat 17 and the rheostat 18 are employed. Also, the control of the current density and the control of the period of time of electrolysis are easily accomplished by adjusting the position of the guide rollers 12 in the electrolytic coloring bath 7, controlling the value of the rheostat 18, and controlling the traveling speed of the aluminum strip or wire.

Figure 2:
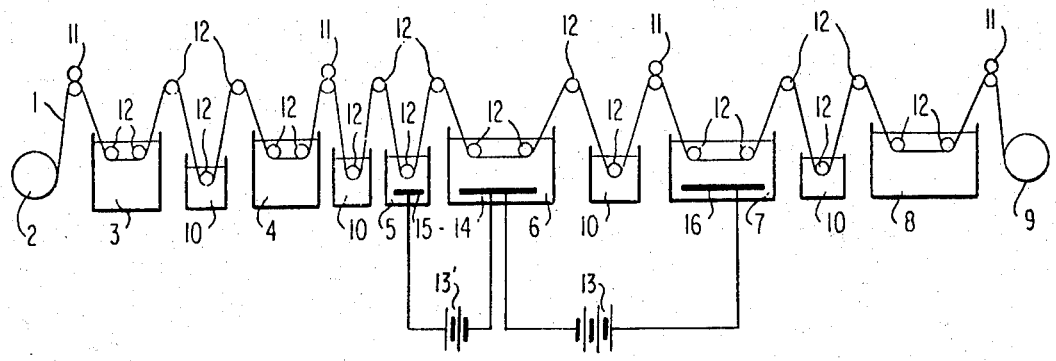
FIG. 2 illustrates a second embodiment of this invention.

Therefore, the number of rheostats employed in this invention can be a single rheostat even though two rheostats are employed in the embodiment illustrated in FIG. 1. Furthermore, the rheostat may not be employed if the control of the amount of the electric current in each route can easily be accomplished by controlling the power source 13. For instance, when two power sources are independently employed for two electric circuits as illustrated in FIG. 2, the amount of the electric current can be easily controlled by the power source, so that in such embodiment, the rheostat may not be employed. In an industrial large apparatus, it is desirable to employ two power sources as illustrated in FIG. 2, since the apparatus becomes simple, a large amount of electric current can easily be applied, and the troubles on electric circuits becomes less. Of course, when two power sources are employed, one or two rheostats may be employed further to control the amount of the electric current in each route.

Also, to accomplish effectively the coloring treatment in the electrolytic coloring bath 7, it is desirable to stir the electrolyte in the bath and the stirring can be by air stirring, by circulation of the electrolyte, or by using one or more stirrers.

In the present invention, the distance between the electrodes in the electrolytic coloring bath 7, that is, the distance between the traveling aluminum strip or wire and the anode 16 substantially does not influence the color of the oxide film, but the potential between them is influenced by variations in the distance.

The aluminum strip or wire passed through the electrolytic coloring bath 7 is introduced in the sealing bath 8 through the wash bath 10. The sealing bath 8 is employed for accomplishing a conventional sealing treatment, such as a treatment with boiling water or a treatment with an aqueous solution containing an inorganic salt such as nickel acetate. If desired, a plurality of baths for this purpose can be employed, and further a coating of a lacquer can replace the sealing treatment. In this case, a dryer, a coating means, and a heat dryer are used in place of the sealing bath 8.

The aluminum strip or wire thus subjected to the sealing treatment or lacquer coating is rolled up on a wind-up roll or a recoiler 9.

The electrodes 14, 15 and 16 can be a carbon plate or an insoluble lead alloy plate, but in particular it is preferable to select the electrode 16 considering the composition of the electrolytic coloring bath. For example, when an electrolyte containing a nickel salt is used for the electrolytic coloring bath, the use of a nickel plate as the anode 16 facilitates a control of the electrolytic bath composition.

Also, for increasing the washing effect of the wash baths disposed at various positions, a water spray means can be used together or a water spray means alone can be used in place of the wash baths in this invention.

Furthermore, it is desirable that the surfaces of the drive rollers 11 and the guide rollers 12 employed in the apparatus of this invention be coated with a material having an excellent insulating property and a resistance to corrosion.

As described above, the method of this invention can produce continuously and with a low cost aluminum strips or wires having colored oxide films or layers thereon superior in weatherability or fade resistance, and hence the industrial value of the apparatus is quite high.

This invention will be further explained in the example shown below by the embodiment illustrated in FIG. 2 of the accompanying drawing, but the scope of this invention will never be limited to this embodiment.

EXAMPLE

The apparatus as shown in FIG. 2 was arranged, but instead of the sealing bath 8, a lacquer coating bath containing a water-soluble clear lacquer and guide rollers, followed by a baking and drying furnace, were disposed, and a degreasing bath 3 was eliminated.

An aluminum strip (99.2% Al, width 65mm and thickness 0.3mm) was arranged on the apparatus as shown in FIG. 2, and the apparatus was operated under the following conditions.

The aluminum strip 1 was introduced at a speed of 20 cm/min. into an etching bath and treated with an aqueous 10% caustic soda solution at a bath temperature of 50° C for 1 minute, and after passing through a wash bath 10, introduced into a current supply bath 5. In the current supply bath 5, the aluminum strip was cathodically electrolyzed using as an electrolytic bath an aqueous 30% sulfuric acid at a current density of 2.0 amperes/cm$^2$ at 25° C for 4.5 minutes. Then the strip was introduced into an anodic oxidation bath 6 and anodically oxidized at a current density of 2.0 amperes/cm$^2$ at 25° C for 5 minutes to form about 3 microns thickness of an oxide film on the surface of the strip. After passing through a wash bath, the aluminum strip was introduced into an electrolytic coloring bath 7 and was subjected to an cathodic electrolysis using an aqueous solution containing 50 g/liter of nickel sulfate and 30 g/liter of boric acid at 1.0 ampere/cm$^2$ at 25° C for 10 seconds; as a result, the strip was colored deep brown. Thereafter, even though the colored aluminum strip was immersed in an aqueous clear lacquer coating bath and then subjected to a curing immersed in an aqueous clear lacquer coating bath and then subjected to a curing treatment by baking, no color change thereof was observed.

In this example, a nickel plate was used for an anode 16 in the electrolytic coloring bath 7, and a carbon was used for an anode 15 in the current supply bath 5 and also for a cathode in the anodic oxidation bath 6.

The thus obtained aluminum strip colored brown was extremely excellent in a processability, and the colored oxide film was extremely superior in resistances to a pressing or a rolling treatment.

While the invention has been described in detail and with reference to specific embodiments thereof, it will be apparent to one skilled in the art that various changes and modifications can be made therein without departing from the spirit and scope thereof.

What is claimed is:

1. A method for continuously electrolytic coloring of an aluminum strip or wire which comprises continuously supplying an aluminum strip or wire into an anodic oxidation bath comprising an aqueous solution containing 10 to 55% by weight of sulfuric acid, said oxidation bath containing a cathode, and then into an electrolytic coloring bath comprising an aqueous solution containing at least one member selected from the group consisting of a nickel salt, a cobalt salt, a copper salt, a tin salt, a ferrous salt and selenious acid, said coloring bath containing an anode, said anode and cathode coupled to an electric circuit including a power source, anodizing said aluminum strip or wire in said anodic oxidation bath by the application of an electrolysis current to said cathode from said power source to form an anodic coating thicker than 2 microns while supplying said aluminum strip or wire into said anodic oxidation bath; and electrolyzing said anodic coating on said aluminum strip or wire while supplying said aluminum strip or wire into said electrolytic coloring bath by the application of current to said anode from said power source to form a colored anodic coating on said aluminum strip or wire wherein said aluminum strip or wire acts as an anode in said anodic oxidation bath and as a cathode in said electrolytic coloring bath without directly connecting said aluminum strip or wire to said power source.

2. The method of claim 1, wherein said anodic oxidation bath further contains magnesium chloride, sodium sulfate, magnesium sulfate, sodium chloride, a carboxylic acid, an organic sulfonic acid, an amine or a mixture thereof.

3. The method of claim 1, wherein the thickness of said anodic coating is from 2 to 6 microns.

4. The method of claim 1, wherein said electrolysis current is a direct current or a direct and alternating superposed current.

5. The method of claim 1, wherein said electrolytic coloring bath further contains ammonium chloride, ammonium sulfate, boric acid, sulfuric acid, an organic acid or a mixture thereof.

6. The method of claim 1, further comprising the steps of: immersing said aluminum strip or wire into a current supplying bath before supplying said aluminum strip or wire into said anodic oxidation bath, said current supplying bath containing an anode and coupled to said power source, said cathode disposed in said anodic oxidation bath being connected to said power source such that upon application of an electrolysis current said aluminum strip or wire acts as a cathode in said current supplying bath and as an anode in said anodic oxidation bath without directly connecting said aluminum strip or wire to said power source.

7. The method of claim 6, wherein two power sources are independently employed, the first power source associated with said anodization bath and the second power source associated with said coloring bath.

* * * * *